US005150816A

United States Patent [19]

DeCastro

[11] Patent Number: 5,150,816

[45] Date of Patent: Sep. 29, 1992

[54] NON-SPILLABLE DRINKING CUP

[76] Inventor: Carlos DeCastro, 8980, Chateauneuf, Anjou, Québec, Canada, H1K 4H4

[21] Appl. No.: 719,348

[22] Filed: Jun. 24, 1991

[51] Int. Cl.[5] ..... A47G 19/22

[52] U.S. Cl. ..... 220/711; 220/264; 220/367; 220/375; 220/719

[58] Field of Search ..... 220/254, 263, 264, 281, 220/283, 283, 334, 367, 375, 703, 711, 719, 731

[56] References Cited

U.S. PATENT DOCUMENTS

| | | | |
|---|---|---|---|
| 2,531,503 | 11/1950 | Dick | 220/264 X |
| 3,860,162 | 1/1975 | Schutz | 220/711 |
| 3,964,631 | 6/1976 | Albert | 220/264 X |
| 3,967,748 | 7/1976 | Albert | 220/264 X |
| 3,972,443 | 8/1976 | Albert | 220/264 X |
| 4,099,642 | 7/1978 | Nergard | 220/264 X |
| 4,184,603 | 1/1980 | Hamilton, Sr. | 220/254 |
| 4,303,173 | 12/1981 | Nergard | 220/254 |
| 4,412,629 | 11/1983 | Dart et al. | 220/711 |
| 4,927,047 | 5/1990 | Stuber | 220/263 X |

*Primary Examiner*—Stephen Marcus
*Assistant Examiner*—Stephen Cronin
*Attorney, Agent, or Firm*—Roland L. Morneau

[57] ABSTRACT

A non-spillable drinking cup having a perforated cover and an internally and resiliently hinged flap for closing the perforation in the cover. The perforation is located adjacent the periphery of the cup for allowing the upper lip of the user to downwardly bend the flap and drink from the cup. The cover can be alternatively positioned to upwardly abut against a peripheral flange around the opening of the cup to seal the latter when the cup is knocked over. The cover resiliently abuts against the flange to allow partial opening of the cover by a downward pressure on a portion of the latter.

8 Claims, 7 Drawing Sheets

NON-SPILLABLE DRINKING CUP

FIELD OF THE INVENTION

The present invention relates to the field of drinking cups and more specifically to a cup having a top opening with an inwardly projecting flange and a cover resiliently biased against the flange in order to prevent spillage of the liquid inside the cup when the cup is inadvertently knocked over or dropped. The cover is adapted to be pushed inwardly to allow passage of the liquid during the drinking operation.

All embodiments of the present invention conform to conventional forms of manufacturing and are of simple construction and easy to use as to provide non-spillable drinking cups which are conventional, long lasting and trouble free in operation.

BACKGROUND OF THE INVENTION

It is quite common, especially for children, to knock over or drop their drinking cups, thus spilling the liquid contained inside the cup.

Previous attempts at circumventing this type of problem resulted in the manufacturing of drinking cups having a removable lid which had to be positioned over the opening when the cup was resting unused on a table.

However, this type of structure necessitated the replacement of the cover over the cup everytime the cup rested on the table top and did not prevent spillage when the cup was simply dropped out of the hand of the user.

The same cover which prevents spillage, allows the user, to drink from the cup, without removing the cover.

The present invention is thus adapted to provide a built-in structure which prevents spillage of the liquid inside the cup without the intervention of the user.

Various embodiments of the invention are adapted to prevent spillage of the liquid they contain in the event that they are inadvertently knocked over or dropped. Embodiments disclosed in the present application use the same basic feature whereby a cover is resiliently biased against a flange extendng inwardly from the periphery of the top opening. In some embodiments, the cover is pushed, in others it is pulled. Some of the biasing mechanisms are located inside the cup, others are located outside the cup but in all embodiments the cover seals off the top opening of the cup until the user wishing to drink out of the cup pushes a segment of the cover inwardly creating a passage between the cover and the flange which allows passage of the liquid.

DETAILED DESCRIPTION OF THE DRAWINGS

Figure 6:
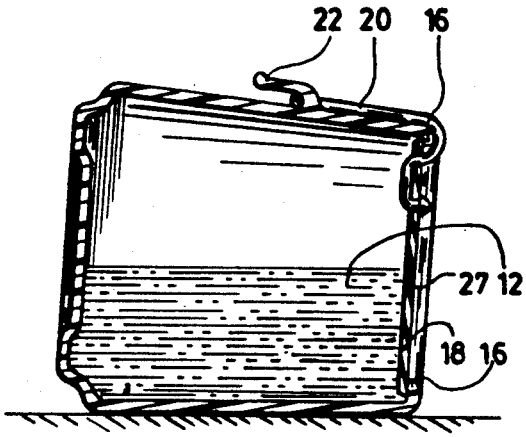
FIG. 6 is a view of the drinking cup resting in a knock-down position.

Referring to FIGS. 1 to 6, there is shown a drinking cup 10 adapted to contain a drinkable liquid referred to in FIG. 6 by the numeral 12. The drinking cup 10 is a tubular container having an aperture 14 at its top end. The aperture 14 is provided with an internal peripheral flange 16. A cover 18 is adapted to internally and upwardly abut on the flange 16 for sealing off the aperture 14.

The cover 18 is resiliently biased against the flange 16 by an elastic means such as an elastic band 20. The elastic band 20 forms a loop around a downwardly projecting L-shaped leg or hook 22 formed integrally with the external periphery of the drinking cup 10. Both ends of the elastic band 20 are threaded through a set of apertures 19 provided in the cover 18. A protuberance or locking knob 21 formed integrally with the elastic band 20 prevents withdrawal from the apertures 19.

As illustrated in FIG. 6, when the cup 10 is knocked over or unvoluntarily tilted, the liquid 12 is prevented from spilling out of the aperture 14 by the cover 18 which circumferentially abuts against the inner surface of the peripheral flange 16.

In these situations, the liquid 12 exerts an internal pressure against the cover .18 further enhancing the abutting relationship of the cover 18 on the flange 16.

Figure 6A:
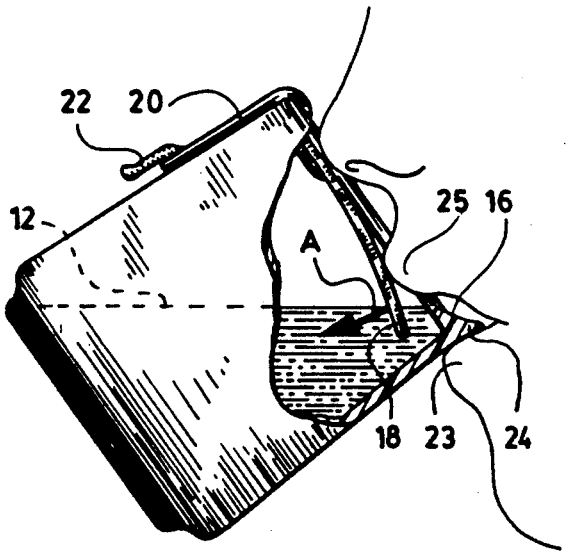
FIG. 6*a* is a view of a person drinking out of the cup.

As illustrated in FIG. 6*a*, in order to drink the liquid 12 out of the cup 10, the user tilts the cup 10 against his lower lip 23 and pushes the cover 18 inwardly, according to arrow A, with his upper lip 25, thus creating a passage between the cover 18 and the internal flange 16.

In order not to create a vacuum inside the cup, air is allowed to penetrate in the cup 10 through a small venting aperture 27 extending through the cover 18. The venting aperture 27 also allows air under pressure to be expelled from the cup 10 while retaining the liquid 12 when the cup 10 is tilted. The hole 27 may serve as a main releasing vent when the liquid 12 is gazefied such as a soft drinks.

Figure 1:
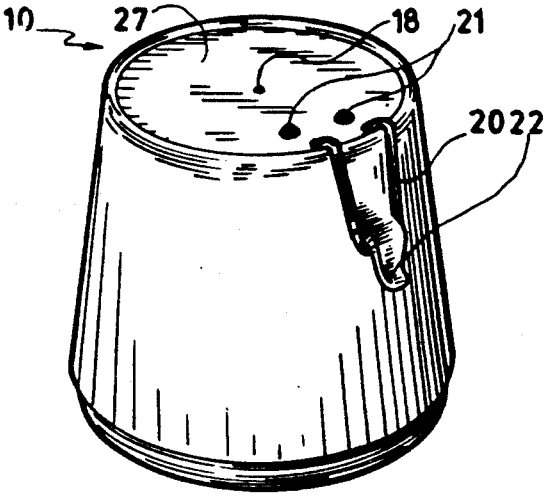
FIG. 1 is a perspective view of a drinking cup embodying the invention.
Figure 2:
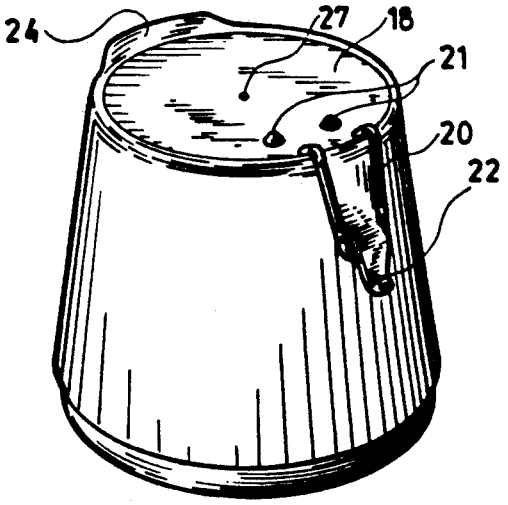
FIG. 2 is a perspective view of an alternative embodiment of the invention having a drinking spout or lip.
Figure 3:
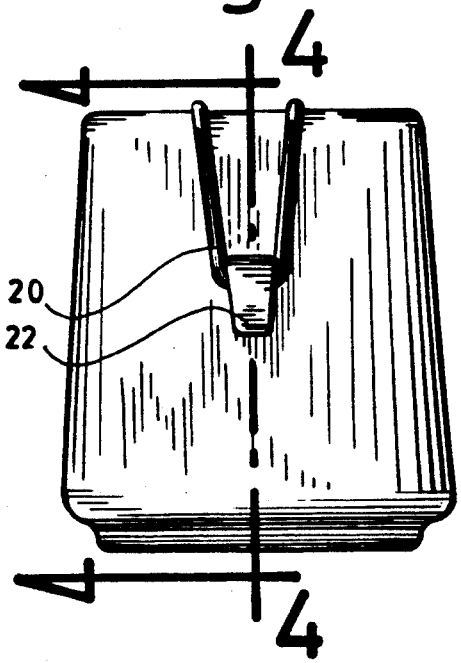
FIG. 3 is an elevation view of FIG. 1.
Figure 4:
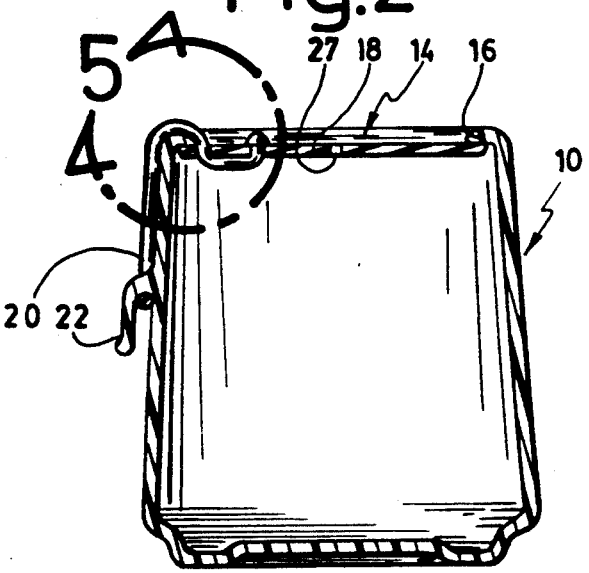
FIG. 4 is a cross-section view taken along line 4—4 of FIG. 3.
Figure 5:
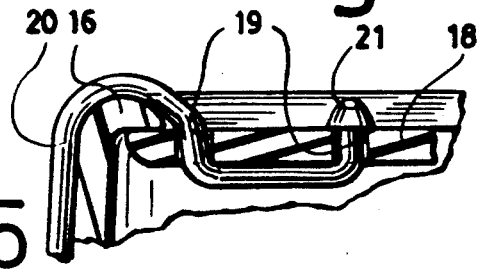
FIG. 5 is a detailed view taken inside arrow 5 of FIG. 4.

In an alternative embodiment of the invention illustrated in FIGS. 2 and 6*a*, a spout 24 is formed integrally at the external periphery of the aperture 14 opposite the L-shaped leg 22. The spout 24 is adapted to prevent unwanted spillage of the liquid around the lip 23, guiding the liquid to the mouth of the drinker, thus facilitating the drinking operation.

Figure 7:
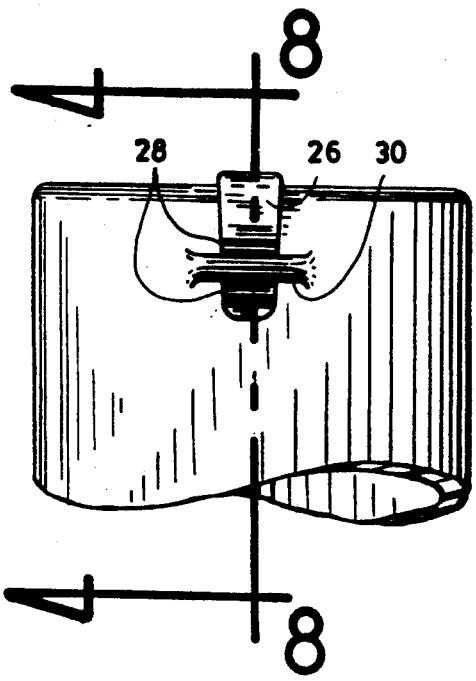
FIG. 7 is an elevation view of an alternative embodiment of the hooking member linking the cover to the cup.
Figure 8:
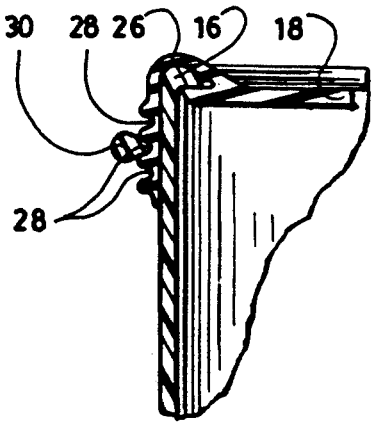
FIG. 8 is a cross-section view taken along line 8—8 of FIG. 7.

In another embodiment of the invention illustrated in FIGS. 7 and 8, the cover 18 is resiliently biased against the flange 16 by a tongue of material 26 extending integrally from the top surface of the cover 18. The tongue 26 is provided with a plurality of indentations 28. A bow 30 extending integrally from the periphery of the cup 10 is adapted to releasably lock a corresponding indentation 28 of the tongue 26 thus providing a means to select the degree of tension in the tongue 26 which biases the cover 18. The force biasing the cover 18 against the flange 16 can therefore be adjusted according to many factors such as the width of the flange 16, the size and the elasticity of the cover 18. The strength of the upper lip of the user is also taken into consideration.

Figure 9:
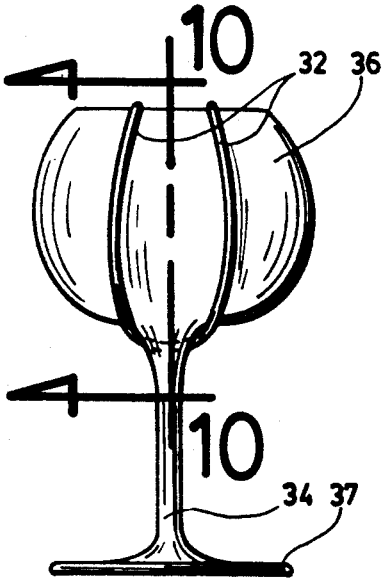
FIG. 9 is an elevation view of an alternative embodiment of the invention especially adapted to wine glass type of cups.
Figure 10:
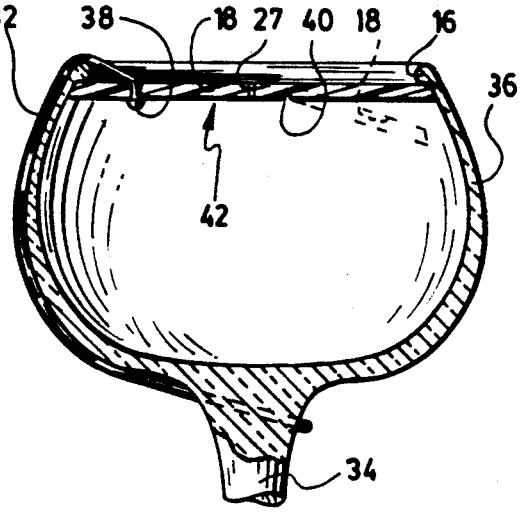
FIG. 10 is a cross-section view taken along line 10—10 of FIG. 9.

Another embodiment of the invention illustrated in FIGS. 9 and 10 is more specifically adapted to glasses having a stem 34 separating the containing part 36 from the base part 37. In this embodiment, the cover 18 is biased against the flange 16 by an elastic band 32. The band 32 is formed into a loop which is anchored around the stem 34 adjacent the base of the containing part 36.

Both ends of the elastic band 32 are threaded through the cover 18 and prevented from retraction by a retaining knob 38 formed integrally with the band 32. An indentation 40 is provided on the inner surface 42 of the cover 18. The indentation 40 creates a weakness across the cover 18 which facilitates its inward bending as illustrated by the dotted lines in FIG. 10.

Figure 12:
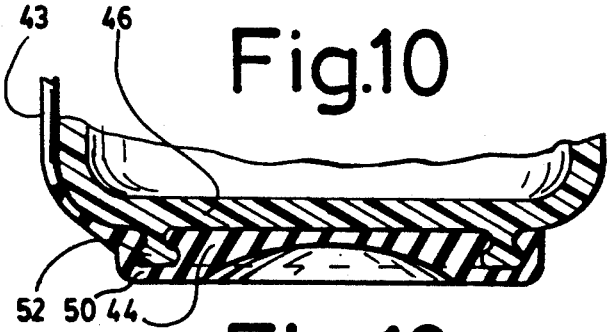
FIG. 12 is a cross-sectional view taken along arrows 12—12 of FIG. 11.
Figure 11:
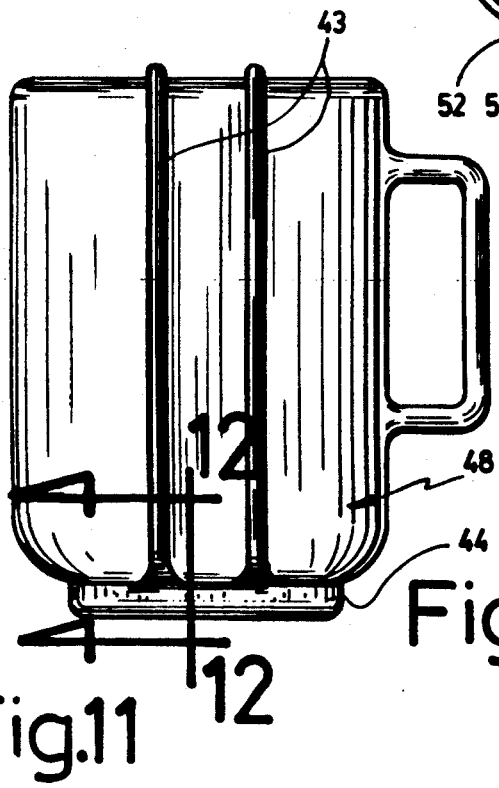
FIG. 11 is an elevation view of an alternative embodiment of the invention wherein the elastics which resiliently close the cover are attached to the bottom of the cup.

In another embodiment of the invention illustrated in FIGS. 11 and 12, a pair of elastic strips 43 pull on the cover (not shown). The strips 43 are formed integrally, at their lower end, with a base component 44. The base component 44 is releaseably fixed to the bottom wall 46 of the container 48 by a tongue and groove arrangement. The base component 44 is provided with a circular groove 50 adapted to releasably receive in a snap-like fashion a circular bead 52 extending integrally from the bottom wall 46 of the container 48.

Figure 13:
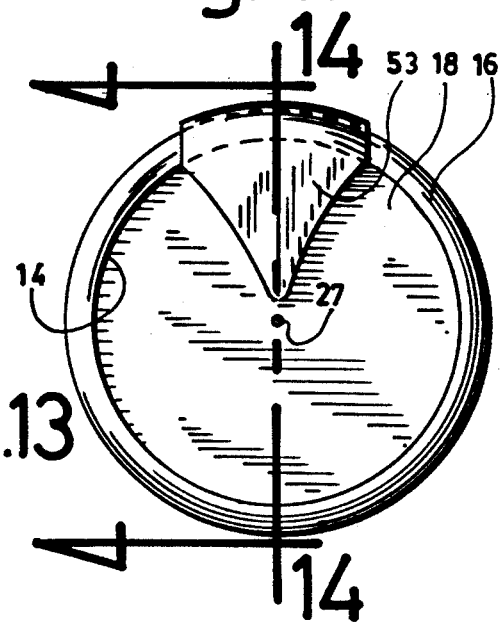
FIG. 13 is a top view of an alternative embodiment of the invention wherein the cover is attached to an exterior peripheral rim.
Figure 14:
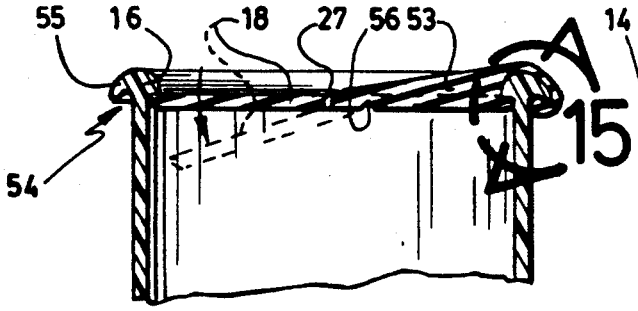
FIG. 14 is a cross-sectional view taken along line 14—14 of FIG. 13.
Figure 15:
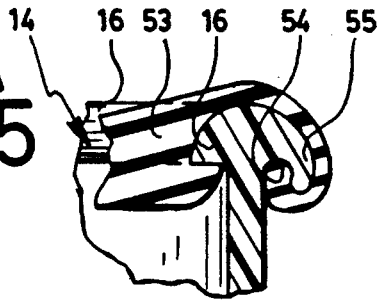
FIG. 15 is a detailed view taken inside arrow 15 of FIG. 14.

In another embodiment of the invention illustrated in FIGS. 13 to 15, to cover 18 is resiliently biased against the internal flange 16 by a snapping tongue 53 having a substantial triangular shape when seen from a top view, as in FIG. 13. The tongue 53 is integrally formed with the cover 18. In this embodiment, the periphery of the aperture 14 is provided with an external flange 55 defining an external peripheral groove 54. The snapping tongue 53 is adapted to curl up around the flange 55 and releasably snap into the groove 54. An indentation 56 in the lower surface of the cover 18 facilitates its inward bending.

Figure 16:
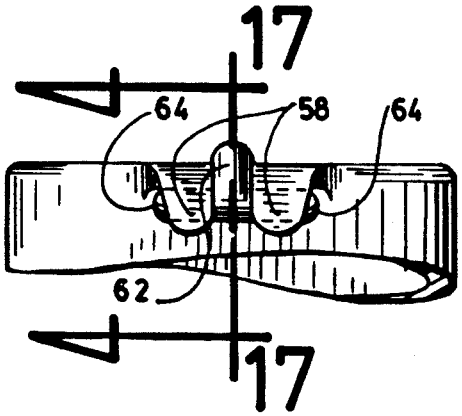
FIG. 16 is a partial elevation view of an alternative embodiment of the invention wherein the cover is attached to the cup by a forked external rim.
Figure 17:
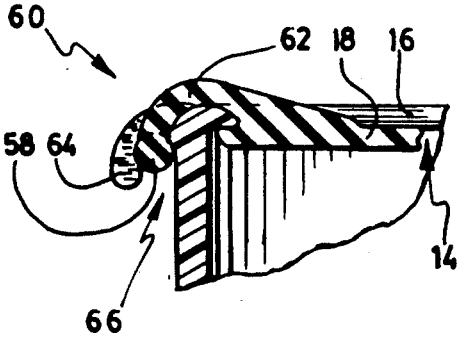
FIG. 17 is a cross-sectional view taken along line 17—17 of FIG. 16.

FIGS. 16 and 17 illustrate another embodiment, wherein a portion of the periphery of the aperture 14 is provided with a forked external flange 58. A substantially T-shaped anchor 60 extends integrally from the cover 18. The anchor has an arched section 62 adapted to curl around the periphery of the aperture 14 in the middle of the forked flange 58 and a pair of prongs 64 extending integrally and orthogonally from the arched section 62. The prongs 64 are adapted to releasably snap into a corresponding pair of external recess 66 defined by the forked flange 58.

Figure 19:
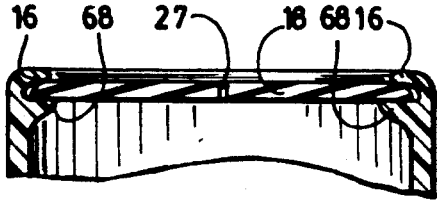
FIG. 19 is a cross-sectional view taken along line 19—19 of FIG. 18.
Figure 18:
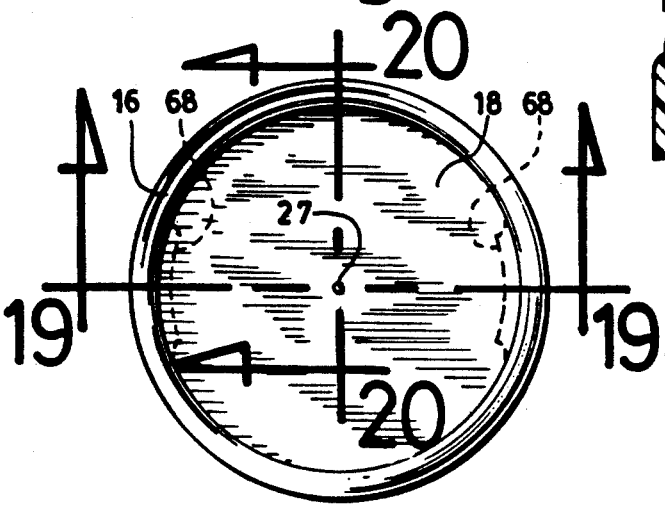
FIG. 18 is a top view of an alternative embodiment of the invention wherein the cover is resting on two internally projecting lips.
Figure 20:
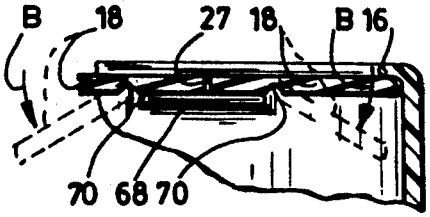
FIG. 20 is a cross-sectional view taken along line 20—20 of FIG. 18.

In another embodiment of the invention illustrated in FIGS. 18 to 20, a pair of internally projecting lips 68 positioned below and adjacent the flange 16 support and biased the cover 18 against the flange 16. A pair of indentations 70 facilitate bending of the cover on each side of lips 68 along two parallel planes as illustrated by arrows B in FIG. 20.

Figure 21:
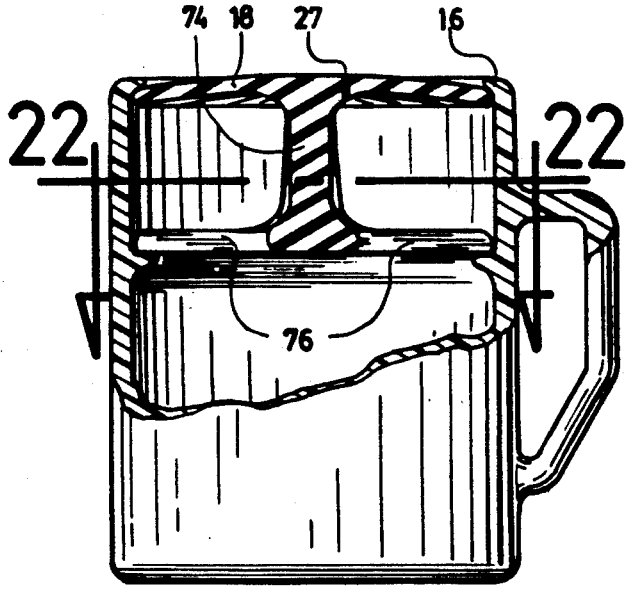
FIG. 21 is an elevation view with a partly cut-out section illustrating an alternative embodiment of the invention wherein the cover is supported by a central post resting on an inwardly projecting internal rim.
Figure 22:
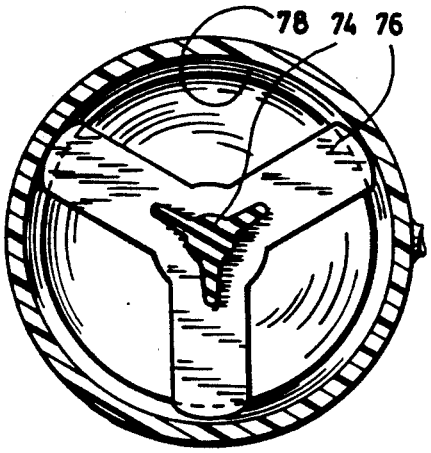
FIG. 22 is a cross-sectional view taken along line 22—22 of FIG. 21.
Figure 23:
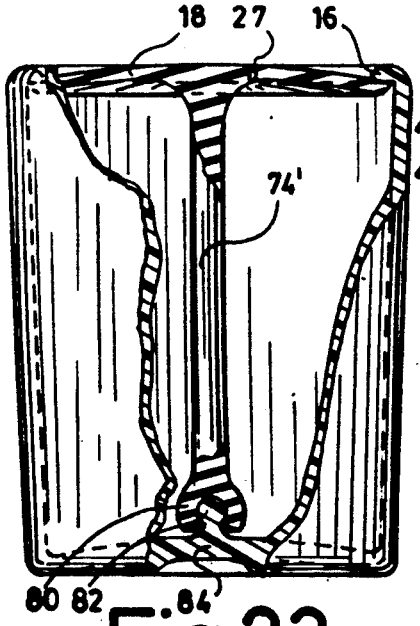
FIG. 23 is an elevation view with a partly cut-out section illustrating an alternative embodiment of the invention wherein the cover rests on the central post fixed to the bottom portion of the cup.

In another embodiment of the invention, illustrated in FIGS. 21 to 23, the cover 18 is supported and biased against the flange 16 by a central supporting post 74 formed integrally with the lower surface of the cover 18.

In one embodiment, illustrated in FIGS. 21 and 22, the supporting post 74 stands integrally into a set of legs 76 which rest on an internally projecting rim 78.

In another version of this embodiment, the central post 74' has a grooved snapping protuberance 80 at its lower end adapted to releasably snap a tongue 82 formed integrally with the inner surface of the bottom wall 84.

Figure 24:
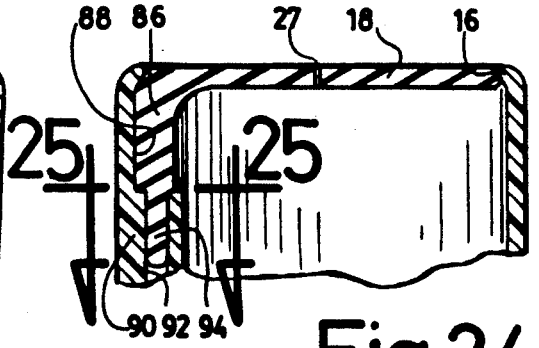
FIG. 24 is a partial cross-sectional view of an alternative embodiment of the invention wherein the cover is supported by a peripheral post.
Figure 25:
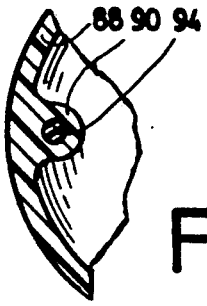
FIG. 25 is a cross-sectional view taken along line 25—25 of FIG. 24.

In another embodiment of the invention illustrated in FIGS. 24 and 25, the cover 18 is formed integrally with a peripheral post 86 which biases the cover 18 against the flange 16. The cylindrical wall 88 of the container is provided with a longitudinal protuberance 90 having a longitudinal recess 92 adapted to receive a narrow section 94 of the peripheral post 86.

Figure 26:
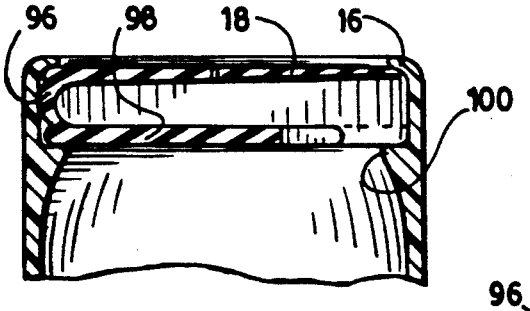
FIG. 26 is a partial cross-sectional view of an alternative embodiment of the invention wherein the cover is supported by a tripod resting on an inwardly projecting rim.
Figure 27:
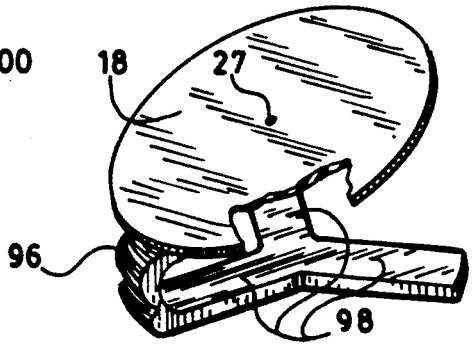
FIG. 27 is a perspective view of the cover mounted on the tripod of FIG. 26.

In another embodiement of the invention illustrated in FIGS. 26 and 27, the cover 18 is formed integrally with a peripheral supporting tongue 96 extending into a set of supporting legs 98. The legs 98 rest on an inwardly projecting rim 100. The tongue 96 is made of a resilient material which biases upwardly the cover 18 against the flange 16.

Figure 28:
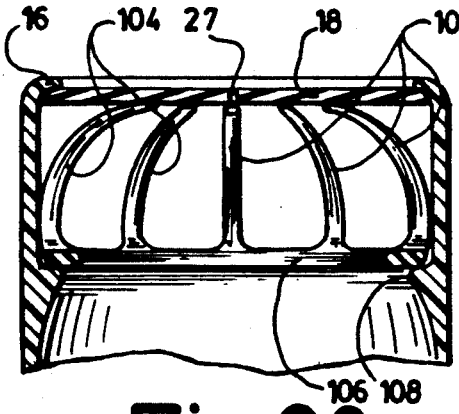
FIG. 28 is a partial cross-sectional view of an alternative embodiment wherein the cover is supported by a supporting structure comprising arcuate ribs biasing the cover against the internal flange.
Figure 30:
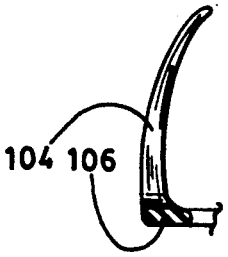
FIG. 30 is a cross-sectional view taken along line 30—30 of FIG. 29.
Figure 29:
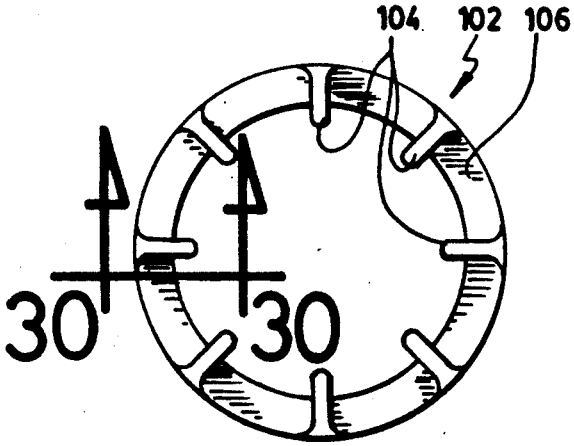
FIG. 29 is a top view of the supporting structure of FIG. 28 with the ribs extended.
Figure 31:
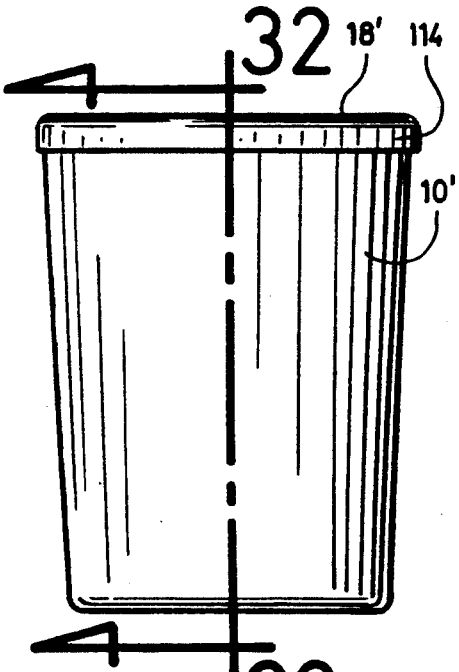
FIG. 31 is a elevational view of an alternative embodiment of the invention wherein the cover laterally seals the cup and has a substantially semi-circular perforation.
Figure 32:
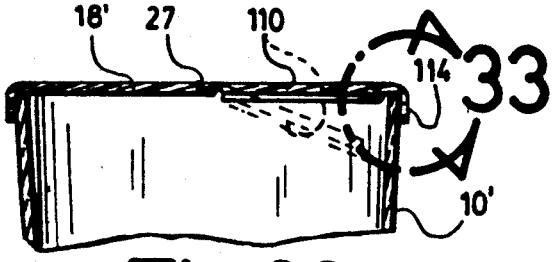
FIG. 32 is a partial cross-sectional view taken along line 32—32 of FIG. 31.
Figure 33:
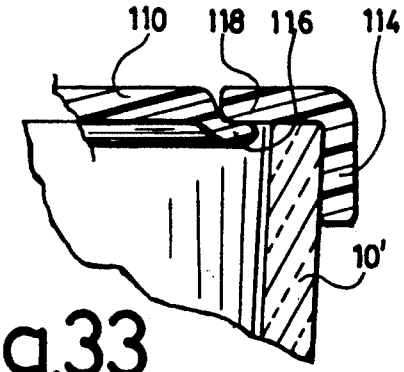
Figure 34:
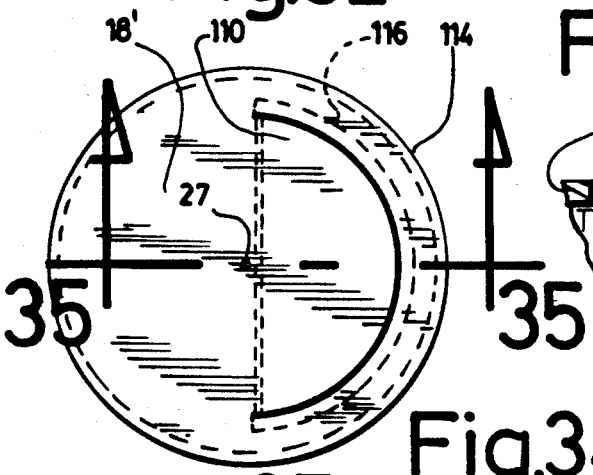
FIG. 34 is a top view of the embodiment of the invention illustrated in FIG. 31.
Figure 35:
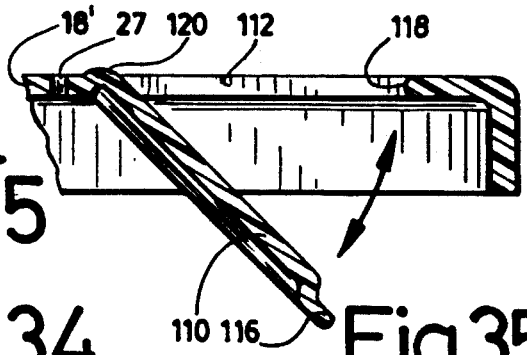
FIG. 35 is a cross-sectional view along line 35—35 of FIG. 34 with the flap opened.

In another embodiment of the invention illustrated in FIGS. 28 to 30 the cover 18 is biased against the flange 16 by biasing structure 102 comprising a set of arcuate resilent ribs 104 extending intergrally and upwardly from an annular base 106. The base 106 rests on an inwardly projecting rim 108.

In another embodiment of the invention illustrated in FIGS. 31 to 35 only a substantially semi-circular flap portion 110 of the cover 18' is adapted to pivot inwardly thus opening a coresponding semi-circular aperture 112.

Contrarly to the previously described structures, the cup 10' does not have an internal flange inwardly projecting from its top aperture. The cover 18' which is removable has a downwardly extending skirt 114 adapted to snap the peripheral wall of the cup 10'.

The arcuate portion of the flap 110 has peripheral flange 116 adapted to abut against a corresponding peripheral section 118 of the semi-circular aperture 112. The flap 110 which is adapted to pivot downwardly is biased upwardly against the peripheral section 118. In this embodiment, the biasing force is provided by the cover 18' itself which is manufactured in resilient polymeric material. The flap 110 is manufactured in a position wherein it seals off the corresponding opening 112. Since the material is resilient, when the flap 110 is pushed downwardly it has a tendency to spring back to its original position and the flange is stopped by the peripheral section 118.

In another embodiment of the invention, the cup is provided with a pivoting lever 120 adapted to push the cover 18 downwardly for allowing a person to drink. The lever 120 pivots around a hinge 122 mounted on a handle 124 extending integrally from the cup.

Figure 36:
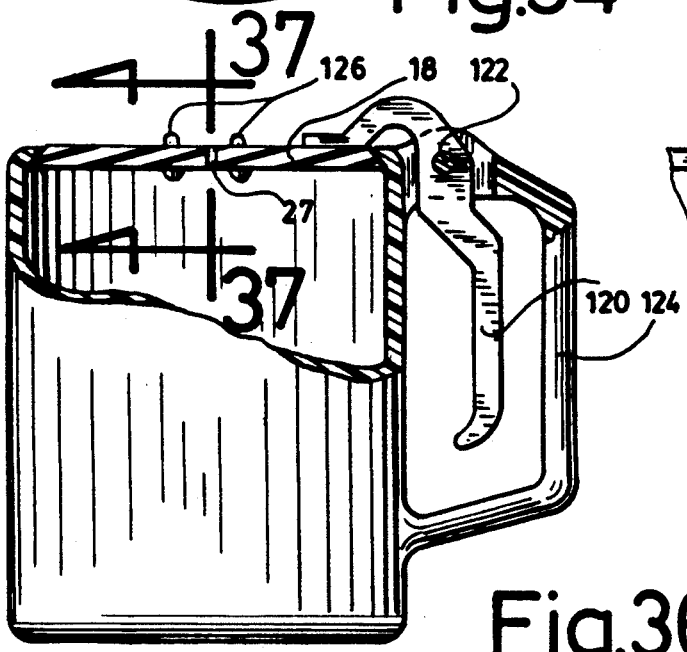
FIG. 36 is an elevation view of the partly cut-out section of an alternative embodiment of the invention wherein the cover is attached to a trigger-type lever.
Figure 37:
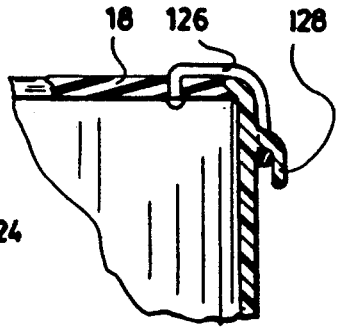
FIG. 37 is a cross-sectional view taken along line 37—37 of FIG. 36.

In the embodiment illustrated in FIG. 36, the cover 18 is biased by an elastic 126 hooked around a downwardly extending L-shaped leg 128, but any of the previously described biasing structures could be used in conjunction with the lever 120.

I claim:

1. A non-spillable drinking cup comprising a tubular container adapted to contain a drinkable liquid, said container having an aperture at its top end, said aperture being provided with an internal peripheral flange, a cover for said container, said cover having a top surface adapted to internally and upwardly abut on said flange for closing said aperture, a stretchable member laterally fixed on said container and on said top surface of said cover for resiliently maintaining said cover against said flange, whereby when said container, containing liquid, is knocked over, the liquid is projected against the cover to enhance the abuting relationship of the cover on the flange.

2. A non-spillable drinking cup as recited in claim 1, wherein the stretchable member is an elastic band secured to the cover and to an external portion of the container, said band having contracting power sufficient to maintain the cover in contact with the flange.

3. A non-spillable drinking cup as recited in claim 2, comprising a releasable hooking member secured on the side of the container, said band being releasably secured to said hooking member.

4. A non-spillable drinking cup as recited in claim 3, wherein said hooking member is downwardly projecting L-shaped leg and said band is an elastic string forming a loop for engaging said leg.

5. A non-spillable drinking cup as recited in claim 3, wherein said band has a plurlaity of indentations for providing a selected degree of tension on said hooking member.

6. A non-spillable drinking cup as recited in claim 5, wherein said cover is made of a flexible material wherein liquid can be expelled from said container, when the container is upside down, by an inward pressure on a portion of the cover along a segment away from the band.

7. A non-spillable drinking cup as recited in claim 6, wherein said cover comprises a small hole for allowing air under pressure to be expelled from the container while retaining the liquid when the container is upside down.

8. A non-spillable drinking cup as recited in claim 1, wherein said container comprises a spout around said aperture at a location substantially opposite said stretchable member.

* * * * *